US005317762A

United States Patent [19]

Horst et al.

[11] Patent Number: 5,317,762

[45] Date of Patent: Jun. 7, 1994

[54] AUTOMATIC TOILET CLEANER DEVICE

[75] Inventors: Bertram Horst; Bernhard Bongers, both of Duesseldorf; Erich Tuerk; Volker Weiss, both of Langenfeld; Ronald Menke, Mettmann, all of Fed. Rep. of Germany

[73] Assignee: Henkel Kommanditgesellschaft auf Aktien, Duesseldorf, Fed. Rep. of Germany

[21] Appl. No.: 671,736

[22] PCT Filed: Sep. 29, 1989

[86] PCT No.: PCT/EP89/01144

§ 371 Date: Apr. 8, 1991

§ 102(e) Date: Apr. 8, 1991

[87] PCT Pub. No.: WO90/04069

PCT Pub. Date: Apr. 19, 1990

[30] Foreign Application Priority Data

Oct. 8, 1988 [DE] Fed. Rep. of Germany ..... 3834262

[51] Int. Cl.[5] ..... E03D 9/03

[52] U.S. Cl. ..... 4/222.1; 4/227.2; 4/227.4; 4/227.7

[58] Field of Search ..... 4/222, 225.1, 226.1, 4/227.1, 227.2, 227.3, 227.4, 227.5, 227.6, 490; 222/64, 67, 68; 422/261, 265

[56] References Cited

U.S. PATENT DOCUMENTS

| | | | |
|---|---|---|---|
| 4,453,278 | 6/1984 | Doggeti et al. | 4/222 |
| 4,530,118 | 7/1985 | Richards | 4/227.6 |
| 4,534,070 | 8/1985 | Hauptmann et al. | 4/227.1 |
| 4,534,071 | 8/1985 | Russomanno | 4/228 |
| 4,764,992 | 8/1988 | Delia | 4/228 |
| 4,828,803 | 5/1989 | Nicholson et al. | 4/222 |

FOREIGN PATENT DOCUMENTS

| | | | |
|---|---|---|---|
| 402171 | 4/1968 | Australia | 4/227.1 |
| 44034 | 1/1982 | European Pat. Off. | 4/227.4 |
| 2830965 | 1/1980 | Fed. Rep. of Germany . | |
| 1560302 | 3/1969 | France . | |
| 3349 | of 1893 | United Kingdom | 4/227.4 |

*Primary Examiner*—Henry J. Recla
*Assistant Examiner*—Charles R. Eloshway
*Attorney, Agent, or Firm*—Ernest G. Szoke; Wayne C. Jaeschke; Kenneth Watov

[57] ABSTRACT

An automatic toilet cleaner container including a lateral opening and an opening at its upper end, is adapted for releasing an active-substance concentrate only during flushing. A float is included for free floating of the toilet cleaner as a whole with the exit of the lateral opening being kept permanently below the water surface. The lateral opening is provided on the upper part of the container opposite a solid cleanser. The lateral opening is safeguarded against outflow of the active-substance concentrate when the water tank is full.

20 Claims, 3 Drawing Sheets

AUTOMATIC TOILET CLEANER DEVICE

BACKGROUND 1.0 Field of the Invention

This invention relates generally to automatic cleaning devices, and more particularly to such devices comprising a container with a lateral opening to accommodate a solid toilet cleanser which dissolves in water to form an active-substance concentrate.

2.0 Discussion of Related Art

A plastic container for a disinfectant and/or cleanser to be fitted into the water tank of a toilet is described in DE-OS 28 30 965. This known automatic toilet cleaner consists of a plastics material having a specific gravity of more than one and is intended to remain on the bottom of the filled water tank until its contents have been used up. The plastics container of this known automatic toilet cleaner consists of a lower part accommodating the water-soluble cleanser and of an upper part open at its upper end and adjoining the lower part. The known container has a lateral bore immediately above the maximum filling level of the cleanser.

For practical application, the known automatic toilet cleaner may be placed in the cistern of a toilet. Under the effect of its low center of gravity, the toilet cleaner automatically rights itself during immersion so that its opening faces upwards and is slowly filled with water through the lateral bore so that it sinks to the bottom of the water tank. The water in the container dissolves the cleanser so that an active-substance concentrate is formed in the container. During emptying of the water, the concentrate is intended to be dispensed into the remaining water flowing to the toilet after the water level in the tank has fallen to below the height of the container.

In the above-mentioned automatic toilet cleaner known from DE-OS 28 30 965, a circulation can be established through the upper opening and the lateral opening of the container even when the water tank is not in use so that the water in the water tank becomes increasingly concentrated with active substance before flushing. The consumption of cleanser is correspondingly high even when the water tank is not in use.

SUMMARY OF THE INVENTION

An object of the present invention is to provide an automatic toilet cleaner device from which active-substance concentrate is only released when the water in the water tank has mostly been emptied. In one embodiment the automatic toilet cleaner device includes a container accommodating the toilet cleanser in its lower part with a lateral outlet opening for the active-substance concentrate. The upper part of the container opposite the lower part accommodating the toilet cleanser comprises a float to enable the automatic cleaner as a whole to float freely in such a way that the exit of the lateral opening always remains below the water level of the filled water tank and in that the lateral opening is safeguarded against outflow of the active-substance concentrate when the water tank is full.

Through the invention, the automatic toilet cleaner always floats when the water tank is full although the single, lateral opening of the container basically provided as an exit for the active-substance concentrate lies below the water surface. In another embodiment, a second container opening for filling or emptying the interior of the container, which is required at least for venting or airing, is always situated above the water surface so that the water in the the water tank is unable to circulate through the container.

In yet another embodiment for producing a safeguard against the unwanted escape of the active-substance concentrate from the lateral opening, the lateral opening is arranged and designed in such a way that the active-substance concentrate, which generally has a higher specific gravity than pure water, is unable to flow out from the lateral opening—on account of the higher density—before the release of active substance is required when the toilet is in use.

In a first alternative of another embodiment of the invention, at least one buoyant element which allows the container to float substantially upright is provided as the float. In a second alternative, an air chamber in the container which allows the container to float substantially upright may also be provided as the float. To this end, the container is intended to comprise a vent tube which dips downwards at its upper end, but terminates above the level of the lateral opening, otherwise being closed in use apart from the vent and the lateral opening. A container such as this filled with toilet cleanser according to the first or second alternatives can simply be placed in the water tank and does not have to be tied or hung up. In the first alternative, the floating depth is determined by the choice of the buoyant element and, in the second alternative, by the length of the vent tube projecting into the interior of the container and the resulting size of the air chamber formed. Through this floating depth, the container is filled with water through the lateral opening which is basically designed for the release of active substance. Accordingly, the automatic toilet cleaner of the first or second alternative has two openings, namely the lateral opening and the upper (vent) opening although the latter can never dip into the water so that, although water is able to penetrate into the container through the lateral opening, it is unable to flow out because of the lack of any possibility of circulation.

A further improvement in the first or second alternative is obtained in another embodiment, if the lateral opening is formed in a shoulder provided transversely of the vertical longitudinal axis of the container so that the normal of the lateral opening runs substantially parallel to the longitudinal axis. This arrangement of the water inflow and concentrate outflow opening parallel to the longitudinal axis has the surprising effect that the active-substance concentrate dissolved in the container is held in or even pressed into the interior of the container in the floating position of the toilet cleaner. On account of its relatively high specific gravity, the active-substance concentrate is unable to flow out from the opening which is directed upwards in another embodiment of the invention.

When the toilet is flushed and the water drains, the automatic cleaner sinks to the bottom of the water tank and is emptied on the physical principle of communicating tubes.

In one embodiment, a substantially cylindrical shape is envisaged for the container of the automatic toilet cleaner. In another embodiment of the invention, however, increased resistance to the force of the outflowing water and better circulation around the active substance are obtained if the container has a substantially conical wall with a downwardly increasing diameter. In addition, if it is cylindrical or conical, it can be favorable for the container to be closed at its lower end by a cover having a conical wall or side with a downwardly decreasing diameter. The fact that the side of the cover tapers conically downwards reduces the danger of the automatic toilet cleaner becoming entangled with the rods in the water tank.

In a third alternative of the automatic toilet cleaner according to the invention, at least one buoyant element which tilts the container towards the lateral opening during floating is provided as the float, a siphon with an upwardly directed elbow or apex and a downwardly directed outlet or inlet is integrally formed on the outside of the lateral opening and, laterally of the apex, the siphon comprises an air chamber with an air pocket which closes the apex on floating and tilting of the container. A container such as this filled with toilet cleanser is also simply placed in the water tank and does not have to be tied or hung up. A floating depth is determined by the float. At the intended floating depth, the container is filled with water through the siphon outlet. It is only this inflow of water into the container which again dissolves the solid active substance. Since, according to the invention, the siphon is closed by an air pocket when the container is tilted by floating, any communication between the interior of the container enriched with active substance and the pure water remaining outside is prevented.

In the third alternative of the automatic toilet cleaner described above, it is important that, irrespective of the level to which it is filled with remaining cleanser, the container should always sink in the water of the water tank to such a depth that the siphon is always completely below the water level. Accordingly, the buoyant elements and their dimensions are selected so that the container assumes an inclined position on floating. The buoyant element(s) are preferably designed and arranged to tilt the floating container at an angle of about 45°. In this inclined position, the outlet of the siphon is immersed and an opening in the upper side of the container remains above the water level. According to the invention, an air pocket in an air chamber adjoining the siphon moves into the apex of the siphon in the inclined position of the container. Accordingly, the siphon in this embodiment is closed by an air pocket and is not a typical siphon closed by a liquid.

According to the invention, the desired inclined position of the floating automatic toilet cleaner in the third alternative can be achieved by one or more buoyant elements on or inside the container. As in the first two alternatives mentioned, the buoyant elements may consist, for example, of cork, Styropor or the like. A defined inclined position is readily achieved by providing a relatively small buoyant element on the side of the container above the siphon and a relatively large buoyant element on the opposite side of the container.

When the free-floating automatic toilet cleaner according to the last alternative with an automatic self-sealing siphon strikes the bottom of the water tank as the water level therein falls, the geometry and weight distribution are selected so that the automatic toilet cleaner is self-righting. As a result, the air pocket is displaced from the siphon elbow into an air chamber provided laterally thereof and, after the water level has fallen further, the active-substance concentrate in the container is able to flow into the remaining emptying water.

Righting of the container when it reaches the bottom of the water tank is facilitated and unwanted tilting of the floating container when most of the relatively heavy active substance has been used up is prevented if, in its lower part, particularly in the tightly closing cover provided there, the container has a specific gravity of more than one. In all the alternatives, this choice and/or distribution of material ensures that the automatic toilet cleaner safely assumes the particular vertical or inclined position required on floating or standing.

In general, it is desirable to allow the flushing water flowing down into the toilet to run down in pure form at first and only to take up active substance at the end. In another embodiment of the invention, this requirement is also satisfied if the height of the container and the distance between the lateral opening and the bottom of the container are selected so that the active-substance concentrate only flows into the last two to three liters of the emptying contents of the water tank. The lateral opening for the outflow of active substance is closed as long as the water level around the container has not fallen below a certain level. Accordingly, the various dimensions of the automatic toiler cleaner according to the invention and, optionally, even the position of the vent tube may readily be selected so that the active-substance concentrate is only introduced into the last two to three liters of the contents of the water tank.

Finally, in another embodiment of the invention, the size and/or arrangement lateral opening of the container are designed for the controlled release of perfume. This solution applies above all to that alternative of the automatic toilet cleaner according to the invention in which no siphon is attached to the lateral opening. If the normal of the lateral opening is designed in a certain way at an angle of 0° to 90° to the longitudinal axis of the container, perfume can be released in doses determined in advance between strong and very weak.

BRIEF DESCRIPTION OF THE DRAWINGS

Various embodiments of the present invention are described in detail below with reference to the accompanying drawings in which like items are identified by the same reference designation, wherein.

DETAILED DESCRIPTION OF THE INVENTION

Figure 1:
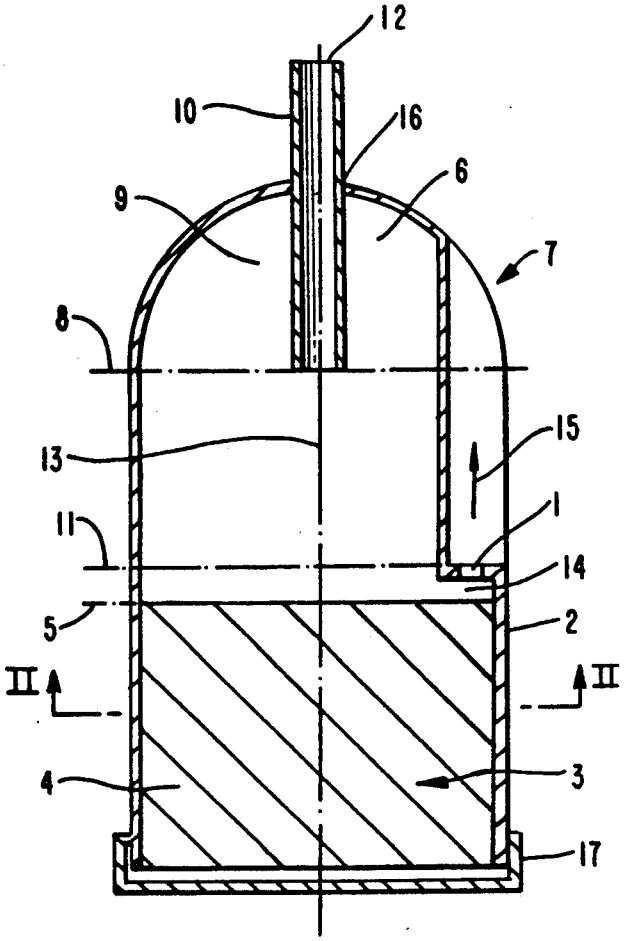
FIG. 1 is a longitudinal section through an automatic toilet cleaner with a float in the form of an air chamber of one embodiment of the invention.
Figure 2:
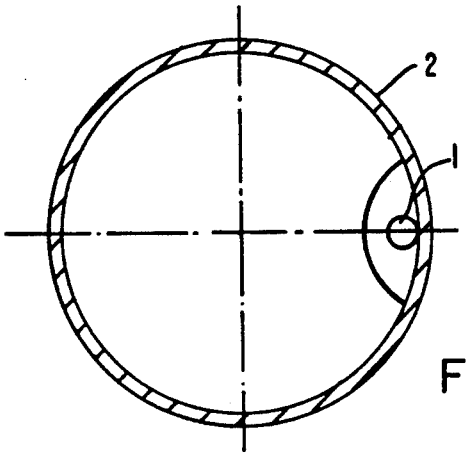
FIG. 2 is a cross-section on the line II—II of FIG. 1.

The automatic toilet cleaner embodiment shown in FIGS. 1 and 2 has a lateral opening 1 in a container globally denoted by the reference 2 which, in its lower part 3, accommodates a solid, but water-soluble toilet cleanser 4. The lateral opening 1 of the container 2 is situated above the maximum level 5 of the toilet cleanser 4. In addition, the lateral opening 1 serves both as an exit for the active-substance concentrate formed during dissolution of the toilet cleanser 4 when the water tank (not shown) empties, and as an entrance for the pure water which rises again during refilling of the water tank. The upper part 6 of the container 2 opposite the lower part 3 accommodating the toilet cleanser 4 comprises a float designed for free floating of the automatic toilet cleaner globally denoted by the reference 7 with the exit of the lateral opening 1 kept permanently below the water surface 8 of the filled water tank. In the embodiment illustrated in FIG. 1, the float is formed by an air chamber 9.

In the embodiment shown in FIGS. 1 and 2, a vent tube 10 projects downwards into the air chamber 9 of the upper part 6 of the container 2. The vent tube 10 terminates above the level 11 of the lateral opening 1. It is pushed so far into the upper part 6 that at least the upper opening 12 of the vent tube 10 always projects from the surrounding water surface when the automatic toilet cleaner 2 is afloat. In addition, the lateral opening 1 is formed in a shoulder 14 provided transversely of the longitudinal axis 13 of the container 2 in such a way that the normal 15 of the lateral opening 1 extends substantially parallel to the longitudinal axis 13.

In the embodiment shown in FIGS. 1 and 2, the upper part of the container is closed apart from a bushing 16 for the vent tube 10. Accordingly, to refill or introduce the cleanser 4, a cover 17 is best provided at the lower end of the lower part 3. To guarantee a permanently upright position of the container 2 with a substantially vertical longitudinal axis 13, the cover 17 may be made of a material of relatively high specific gravity so that the container 2 is still upright even when the cleanser 4 is substantially exhausted.

Figure 3:
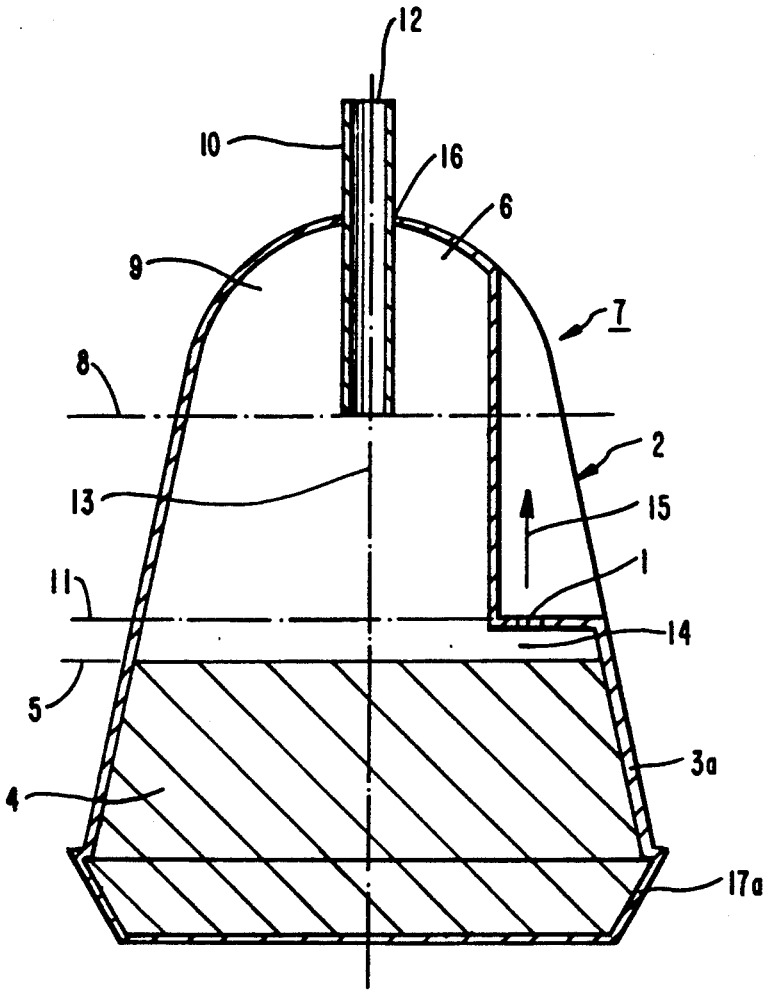
FIG. 3 shows the same automatic toilet cleaner as FIG. 1, but with a conical container.

FIG. 3 shows a modified embodiment of an automatic toilet cleaner in relation to FIG. 1, although the same parts bear the same reference numerals.

Whereas FIG. 1 shows an automatic toilet cleaner 7 with a substantially cylindrical wall of the container 2, the container 2 shown in FIG. 3 is conical in shape, even in its lower part 3*a*, with a downwardly increasing diameter. This provides both for increased resistance to the force of the outflowing water when the container 2 sinks to the bottom of the water tank, and for the improved circulation of water around the active substance.

Finally, FIG. 3 also shows an embodiment of a conical cover 17*a* of which the diameter—again measured perpendicularly to the longitudinal axis 13—decreases downwards. Through its shape, a cover 17*a* such as this, which may be described as counterconical in relation to the conical container 2, reduces the danger of entanglement with the rods in the water tank.

Figure 4:
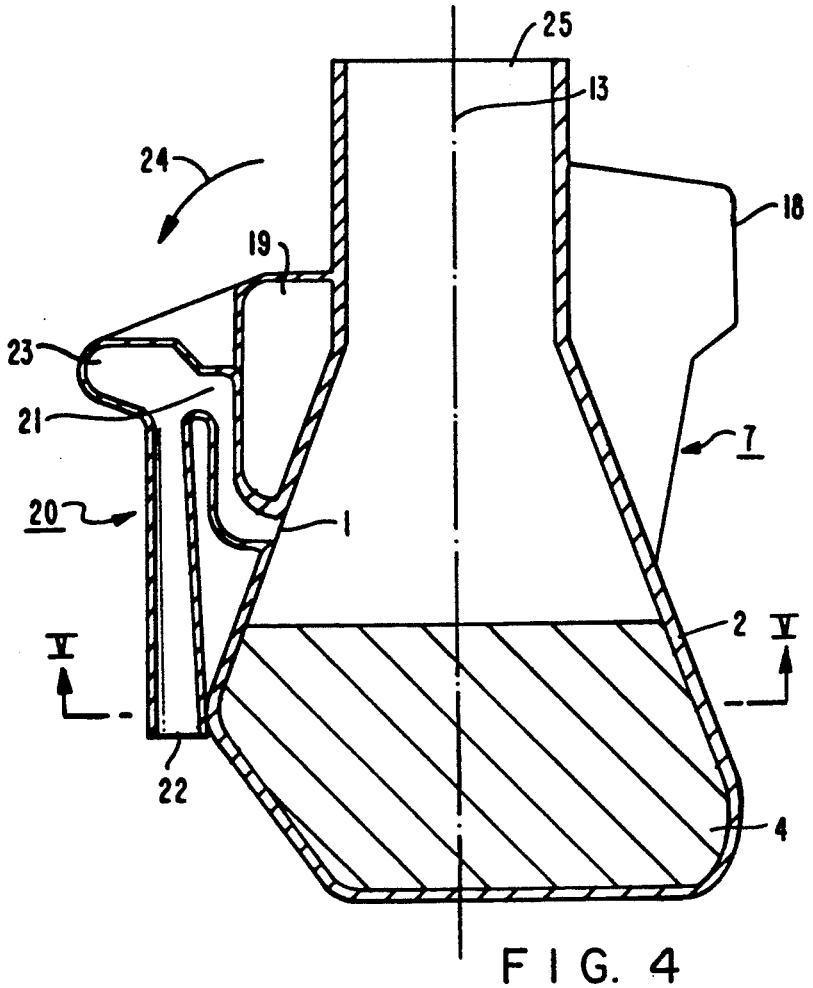
FIG. 4 is a longitudinal section through a free-floating automatic toilet cleaner with an automatic siphon of another embodiment of the invention.
Figure 5:
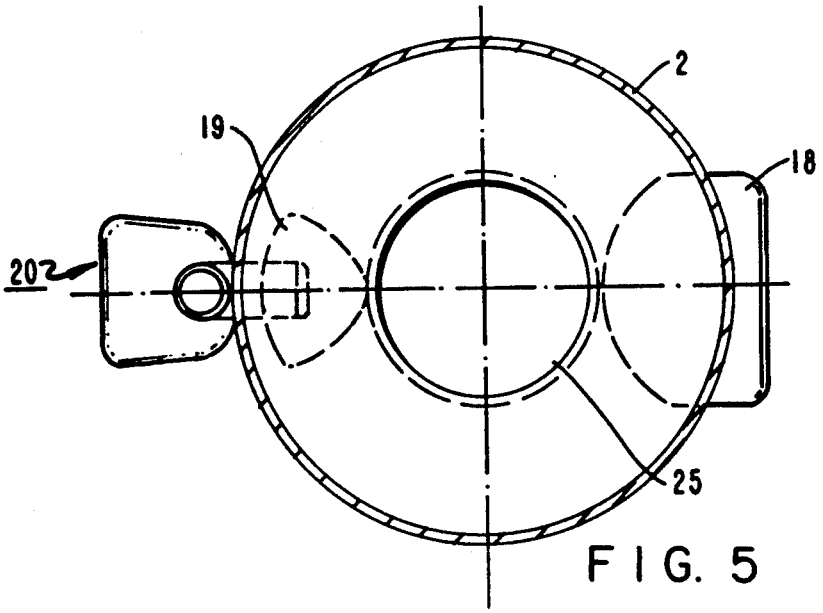
FIG. 5 is a section on the line V—V of FIG. 4.

Another embodiment of the automatic toilet cleaner according to the invention is described with reference to FIGS. 4 and 5. Identical or corresponding parts are denoted by the same reference numerals as in FIGS. 1 and 2. The container 2 shown in FIGS. 4 and 5 comprises two buoyant elements 18 and 19 of different size as floats. A siphon globally denoted by the reference 20 with an upwardly directed elbow or apex 21 and with a downwardly directed inlet or outlet 22 is integrally formed on the outside of the lateral opening 1 of the container 2. Finally, the siphon 20 comprises laterally of the apex 21 an air chamber 23 with an air pocket which is intended to close the apex 21 during floating or tilting of the container 2. This function is performed through the fact that the buoyant element 18 opposite the siphon 20 is considerably larger than the buoyant element 19 adjacent the siphon 20. Accordingly, when the container floats, it tilts in the direction of the arrow 24 so that (for example in a tilted position turned through about 45° relative to the vertical longitudinal axis 13) it is no longer the air chamber 23 but the apex 21 which contains the highest point of the siphon 20. The air pocket originally present in the air chamber 23 therefore moves into the region of the apex 21 and closes the siphon 20.

Although various embodiments of the present invention have been described and illustrated herein, they are not meant to be limiting. Those of ordinary skill in the art may recognize various modifications and further embodiments of the invention, which are meant to be covered by the spirit and scope of the appended claims.

What is claimed is:

1. An automatic toilet cleaner for placement in a water tank of a toilet, comprising a container with a lateral opening, said container accommodating a solid toilet cleanser which dissolves in water to form an active-substance concentrate, said container having a vertical longitudinal axis, said container accommodating the solid toilet cleanser in a closed lower part, the lateral opening of the container being situated above a region maximally occupied by the toilet cleanser, and being adapted both as an exit for the active-substance concentrate during emptying of the water tank, and as an entrance for pure water when the water refills the water tank, an upper part of said container, opposite the lower part accommodating the toilet cleanser, includes a float to enable the automatic cleaner as a whole to float freely in such a way that the active-substance exit of the lateral opening always remains below the water level of the filled water tank, and in that the lateral opening is safeguarded against outflow of the active-substance concentrate when the water tank is full.

2. An automatic toilet cleaner as claimed in claim 1 wherein said float includes at least one buoyant element which allows the container to float substantially upright.

3. An automatic toilet cleaner as claimed in claim 2, wherein said lateral opening is formed in a shoulder provided transversely of the vertical longitudinal axis of the container so that the normal of the opening runs substantially parallel to the longitudinal axis of the container.

4. An automatic toilet cleaner as claimed in claim 2, further including a cover for tightly closing a bottom opening of the lower part, the specific gravity of said cover being sufficiently high for causing said container to have an overall specific gravity of more than one.

5. An automatic toilet cleaner as claimed in claim 1 wherein said float includes an air chamber in the container which allows the container to float substantially upright.

6. An automatic toilet cleaner as claimed in claim 5, further including a vent tube extending through a top portion of the upper part of said container, said vent tube having an upper end protruding out of the top of said upper part, and a lower end terminating inside said container above the level of the lateral opening.

7. An automatic toilet cleaner as claimed in claim 6, wherein said lateral opening is formed in a shoulder provided transversely of the vertical longitudinal axis of the container so that the normal of the opening runs substantially parallel to the longitudinal axis of the container.

8. An automatic toilet cleaner as claimed in claim 5, wherein said lateral opening is formed in a shoulder provided transversely of the vertical longitudinal axis of the container so that the normal of the opening runs substantially parallel to the longitudinal axis of the container.

9. An automatic toilet cleaner as claimed in claim 1, wherein said lateral opening is formed in a shoulder provided transversely of the vertical longitudinal axis of the container so that the normal of the opening runs substantially parallel to the longitudinal axis of the container.

10. An automatic toilet cleaner as claimed in claim 9, wherein said container has a substantially conical wall with a downwardly increasing diameter.

11. An automatic toilet cleaner as claimed in claim 1, wherein said container has a substantially conical wall with a downwardly increasing diameter.

12. An automatic toilet cleaner as claimed in claim 11, wherein said container is closed at its lower end by a cover having a conical wall or side with a downwardly decreasing diameter.

13. An automatic toilet cleaner as claimed in claim 1, wherein said container is closed at its lower end by a cover having a conical wall with a downwardly decreasing diameter.

14. An automatic toilet cleaner as claimed in claim 1, further including at least one buoyant element which tilts the container in the direction of the lateral opening during floating thereof, a siphon with an upwardly directed elbow and a downwardly directed opening, said siphon being integrally connected to the lateral opening, wherein laterally of the elbow, the siphon includes an air chamber with an air pocket which closes the elbow upon floating and tilting of the container.

15. An automatic toilet cleaner as claimed in claim 14, further including both a relatively small buoyant element on a side of the container above said siphon, and a relatively large buoyant element provided on an opposite side of the container.

16. An automatic toilet cleaner as claimed in claim 15, wherein said small and large buoyant elements are adapted and arranged to tilt the floating container at approximately 45° in the direction of the lateral opening.

17. An automatic toilet cleaner as claimed in claim 16, further including a cover for tightly closing a bottom opening of the lower part, the specific gravity of said cover being sufficiently high for causing said container to have an overall specific gravity of more than one.

18. An automatic toilet cleaner as claimed in claim 1, further including a cover for tightly closing a bottom opening of the lower part, the specific gravity of said cover being sufficiently high for causing said container to have an overall specific gravity of more than one.

19. An automatic toilet cleaner as claimed in claim 1, wherein the height of the container and the distance of the lateral opening from the bottom of the container are selected so that the active-substance concentrate only discharges into the remaining two to three liters of water during a flushing cycle of the water tank.

20. An automatic toilet cleaner as claimed in claim 1, wherein the size and arrangement of the lateral opening of the container is designed for the controlled release of a perfume.

* * * * *